United States Patent [19]

Adema et al.

[11] 4,421,048

[45] Dec. 20, 1983

[54] SITU INCINERATION/DETOXIFICATION SYSTEM FOR ANTIFOULING COATINGS

[75] Inventors: Carl M. Adema, Mayo; Paul Schatzberg, Annapolis, both of Md.

[73] Assignee: The United States of America as represented by the Secretary of the Navy, Washington, D.C.

[21] Appl. No.: 313,557

[22] Filed: Oct. 22, 1981

[51] Int. Cl.[3] ..... B63B 59/06

[52] U.S. Cl. ..... 114/222; 134/19; 219/343; 219/347; 219/354

[58] Field of Search ..... 134/1, 38, 10, 19; 432/72; 114/222; 219/347, 343, 346, 354; 126/92 C, 271.2 A

[56] References Cited

U.S. PATENT DOCUMENTS

| | | | |
|---|---|---|---|
| 1,899,704 | 2/1933 | Lutz | 126/271.2 A |
| 2,497,535 | 2/1950 | Carlino | 219/346 X |
| 3,188,459 | 6/1965 | Bridwell | 219/343 X |
| 3,981,252 | 9/1976 | Ticker | 134/19 |

*Primary Examiner*—Sherman D. Basinger

*Attorney, Agent, or Firm*—R. F. Beers; L. A. Marsh

[57] ABSTRACT

An electrical paint stripping device for removing-/detoxifying organotin antifouling coatings includes a housing, a heating chamber containing a plurality of electrical heating elements, and a plenum chamber for cooling air which is separated from the heating chamber by a perforated ceramic separator element. A circumferential exhaust chamber encloses the heating chamber for collecting exhaust gasses from the heating chamber. The collected exhaust gasses are then fed to a treatment device for removing toxic substances therefrom prior to passing the gasses to the environment.

12 Claims, 6 Drawing Figures

SITU INCINERATION/DETOXIFICATION SYSTEM FOR ANTIFOULING COATINGS

BACKGROUND OF THE INVENTION

The present invention generally relates to an apparatus for removing paint coatings from surfaces and, more particularly, to a means for incinerating/detoxifying organotin antifouling materials from ship surfaces.

Operating requirements of the current naval fleets have imposed increasing demands on ship antifouling coatings. For example, fuel conservation, high speed capabilities and extended periods between ship drydockings are naval objectives which have caused the development of newer antifouling coating systems. In the past, the salts and oxides of copper, zinc, arsenic, and mercury were commonly used as antifouling compositions. However, some of these compounds were found to cause corrosion of the metal substrate, degradation of the paint coating, and have a rapid leaching rate that results in a relatively short service life. In overcoming these drawbacks organometallic antifoulants such as tributyltin oxide and tributyltin fluoride have been developed. The organometallic antifoulants are normally incorporated into an organic matrix of materials such as natural rubbers, polyisobutylene, neoprenes, nitrile rubbers, polybutadiene, polyacrylates and epoxy resins. An advantage of these organometallic antifoulants over previous antifoulants, such as cuprous oxide type antifoulant materials, is that the organometallic materials are more toxic to sea life and thus can be utilized in coating systems with low leach rates and a long service life. However, the organometallic antifouling coatings eventually lose much of their effectiveness and need to be removed from the ship hull prior to application of another antifouling coating. Since the old antifouling materials still exhibit a high toxicity, careful removal procedures, as discussed in U.S. Pat. No. 3,981,252 for example, have been developed to prevent contamination of the environment. Such procedures commonly involve scraping and sandblasting the hull to remove the old coating materials, collection of the toxic abrasive grit and antifouling debris, and disposal of the debris in either selected landfills or special incinerators.

SUMMARY OF THE INVENTION

The present invention provides a means for the insitu detoxification of organometallic antifoulants so that the antifouling coatings can be removed from the ship hull without substantial contamination of the environment. The detoxification process involves passing an infrared heater having a high power density over the hull surface to rapidly bring the organometallic antifoulant material above its vaporization temperature. As the antifouling paint is incinerated/vaporized on the hull surface, the vapors are drawn into an exhaust manifold which completely surrounds the heat source. The vapors are then drawn from the exhaust manifold into either an exhaust gas burner, which oxidizes the vapors into nontoxic combustion products, or an activated carbon adsorption column, which removes toxic antifoulant and paint substances from the exhaust gasses. To prevent overheating of the infrared heating elements, cooling air is passed around the heating elements, which are preferably elongated electric lamps.

Accordingly, an object of this invention is the provision of a paint/coating remover which is so constructed and arranged that the user is protected from the heat and toxic vapors emanating from the device and the coated surface.

Another object of the invention is to provide a means for incinerating/detoxifying paint coatings which is simple in construction, easy to use, and which provides a relatively inexpensive method of removing coatings from a surface.

A further object of this invention is to supply a heating means which may be brought into comparatively close relation to the painted surface without fire or electrical hazard and without danger of injuring infrared heating elements in the heating means by the heated/vaporized coating materials.

Still another object of the present invention is to employ an infrared heating means which will generate sufficient radiant energy to penetrate coating layers and produce a uniform heating action therethrough.

Yet another object of this invention is to provide an exhaust gas treatment means for detoxifying the gasses and vapors generated by the infrared heating means.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may be best understood by reference to the following description taken in conjunction with the accompanying drawings, in which:

DETAILED DESCRIPTION OF THE INVENTION

Figure 1:
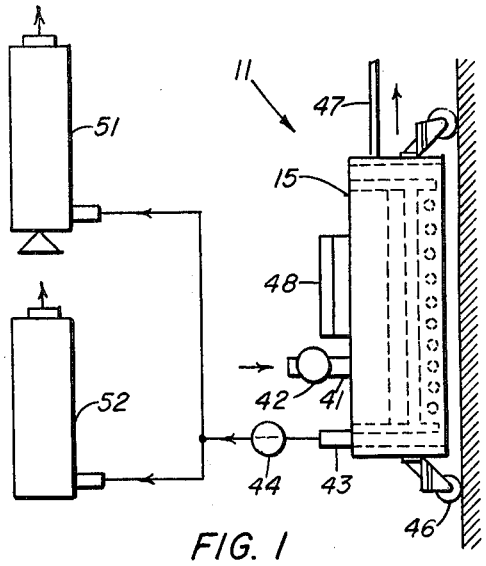
FIG. 1 is a perspective view of the heating unit of the present invention in operative position on a ship hull.

Referring now to the drawings and to FIG. 1 in particular, there is generally shown an infrared heating device of the present invention comprising a heating unit 11 for generating a high amount of heat energy to gasify antifouling materials in the coating and an exhaust gas treatment means for burning/detoxifying exhaust gases from the heating unit 11. The heating unit generally includes a housing 15, a plurality of heating elements 34 positioned within the housing 15, an air inlet 41 for supplying cooling air to the heating elements 34, an exhaust conduit 43 for conveying gasses and vapors from the heating regions of the housing 15, and spacer means for supporting the housing 15 in close proximity to the hull surface 14. The exhaust gas treatment means includes an exhaust gas blower unit 44 for drawing gasses/vapors from the housing 15 and either an exhaust gas afterburner unit 51 for burning/detoxifying the gasses and vapors or an activated carbon adsorption column 52 for removing the toxic antifouling and paint fumes from the exhaust gasses.

Figure 3:
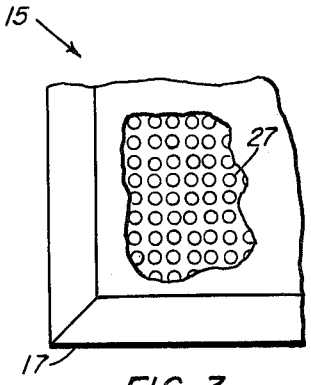
FIG. 3 is a partial top view of the heating unit with a portion thereof broken away to expose the air plenum chamber of the heating unit.
Figure 2:
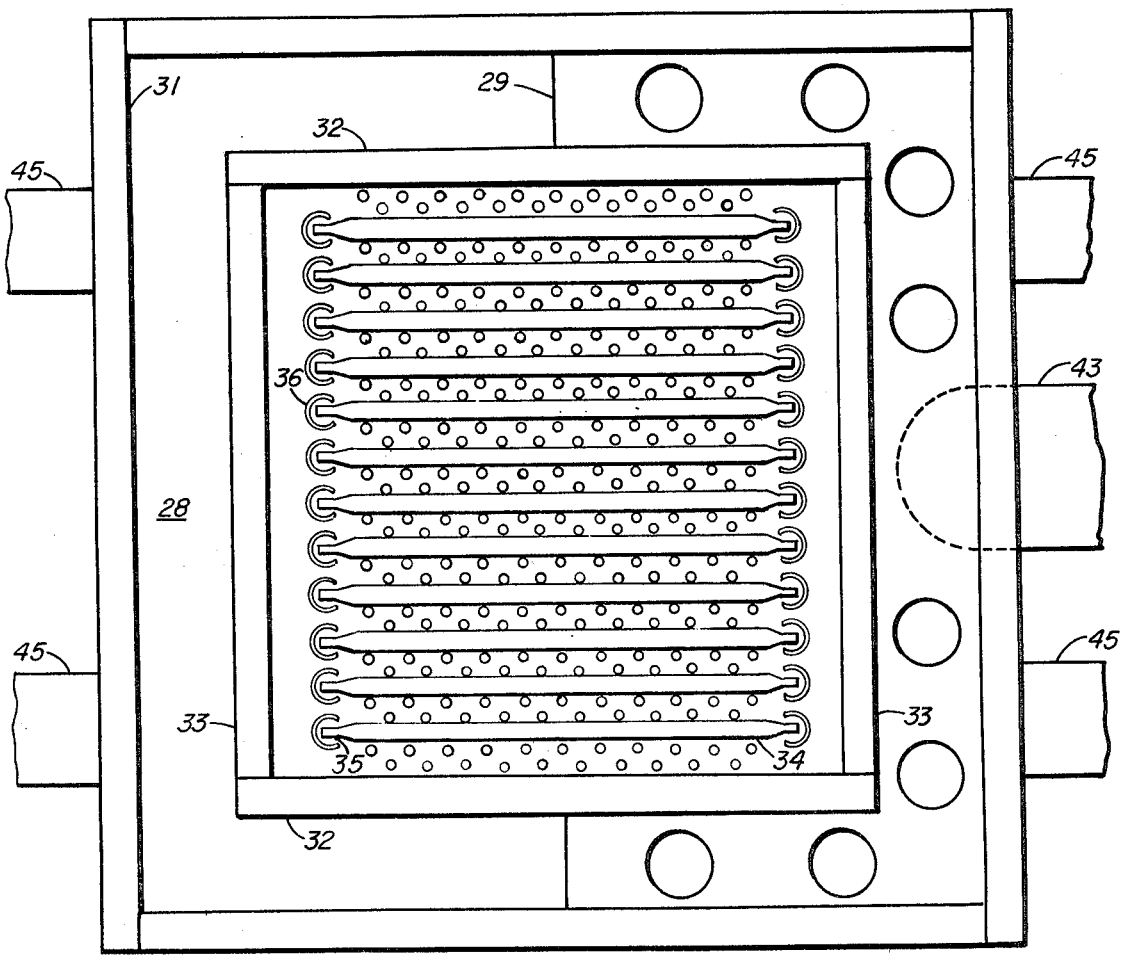
FIG. 2 is a bottom plan view of the heating unit of the present invention.
Figure 4:
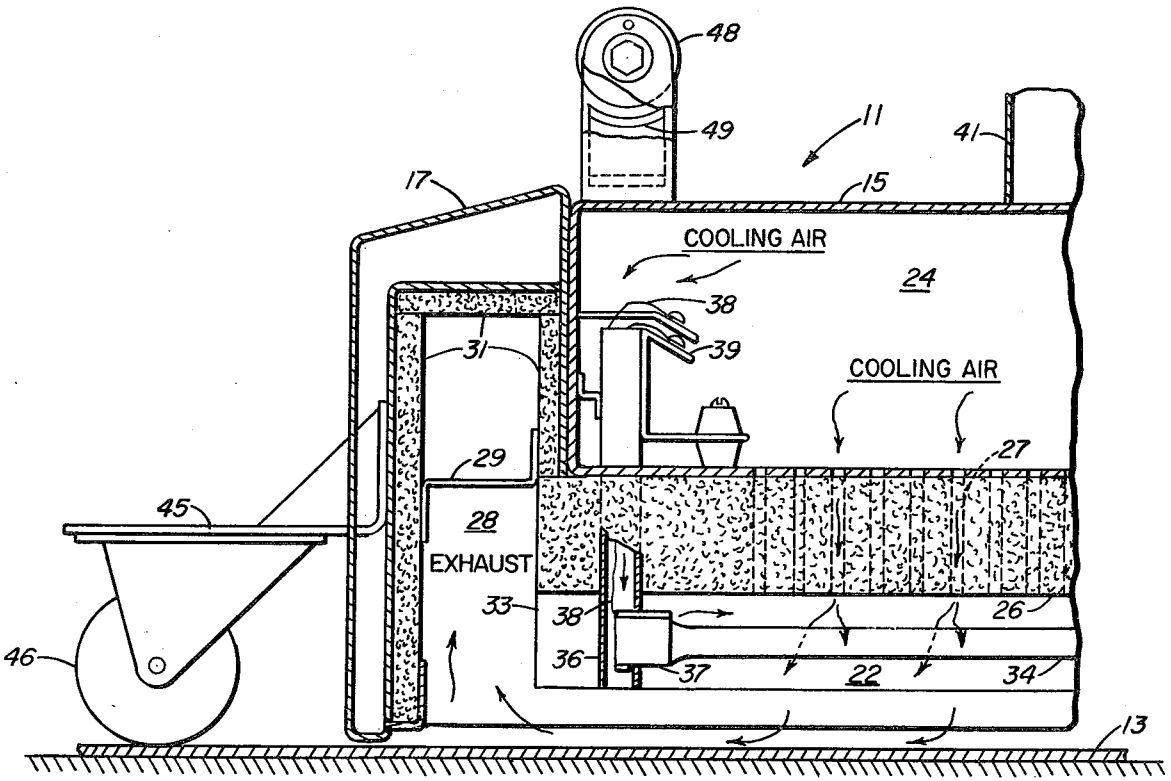
FIG. 4 is a partial sectional view of the heating unit depicting a lengthwise view of the individual heating elements.
Figure 6:
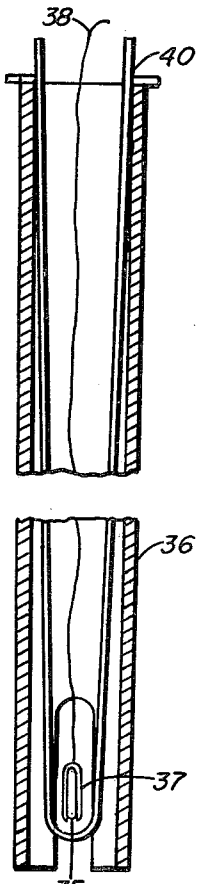
FIG. 6 is an enlarged sectional view of the tubular mounting brackets for the elongated heating elements.
Figure 5:
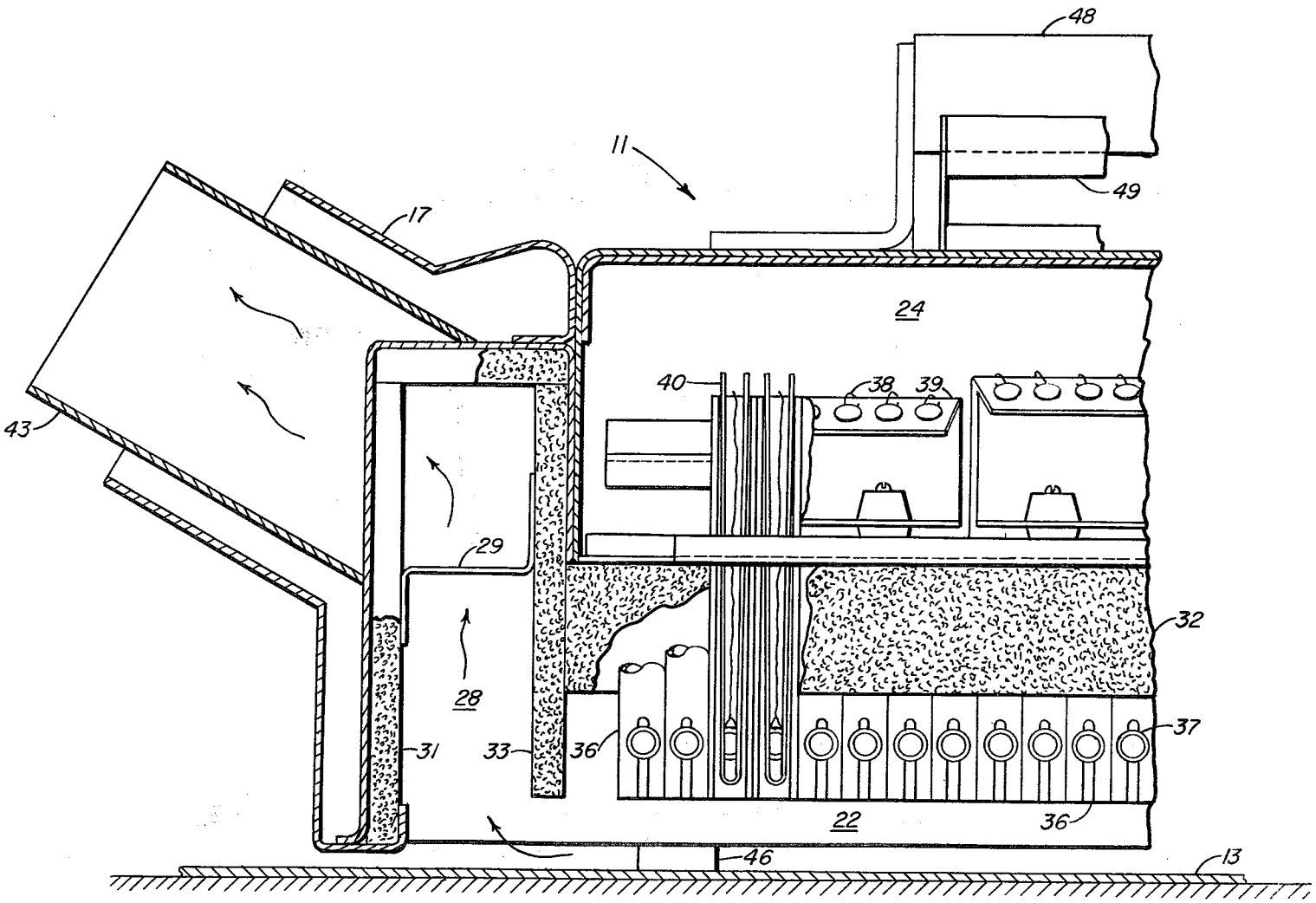
FIG. 5 is another partial sectional view of the heating unit depicting a cross-sectional view of the individual heating elements.

As shown in FIGS. 1, 4 and 5, the housing 15 includes a heating chamber 22 in which the hot gasses/vapors from the coating are initially contained, a plenum chamber 24 connected to the air inlet 41 for supplying cooling air to the heating chamber 22, a perforated ceramic divider element 26 separating the plenum chamber 24 from the heating chamber 22, and a circumferential exhaust chamber 28 surrounding the heating chamber 22. The heating chamber 22, as further shown in FIG. 3, is bordered by ceramic side elements 32,33 that not only contain the toxic gasses emanating from the coating surface but also reduce the transmission of heat energy from the heating chamber 22, thereby directing a large quantity of heat energy into the coating. Hot gasses and vapors emanating from the antifouling coating flow out of the heating chamber 22 to the exhaust chamber 28 which, like the heating chamber, is also lined with ceramic elements 31 to prevent the transmission of the gasses and heat energy therethrough.

The ceramic separator element 26 is provided with a plurality of passages 27 that are arranged in a predetermined pattern so that cooling air in the plenum chamber 24 flows through the passages 27 in sufficient quantities to adequately cool the heating elements 34 and cleanse the region therearound of gasses and other debris that may coat the heating elements to the extent that they overheat and burn out. Cooling air is also supplied through tubular mounting brackets 36 to the end portions 35 of the heating elements 34 so that the end portions of the heating elements are also sufficiently cooled. Cooling air for the plenum chamber 24 is supplied through an air inlet conduit 41 which may contain a blower assembly 42 for maintaining a predetermined air pressure in the plenum chamber 24. A variety of plates and baffles can be positioned within the plenum chamber 24 to evenly distribute the cooling air so the rate of flow through the passages 27 is substantially uniform. Generally, the relative sizes and numbers of the cooling passages 27 in the ceramic divider element 26 and the tubular mounting brackets 36 are arranged so that from about 50 to 65 percent of the total cooling air passes through the tubular mounting brackets 36 and from about 35 to 50 percent of the total cooling air passes through the cooling passages 27. This arrangement provides sufficient uniform cooling of the elongated heating elements 34 to preclude differential overheating of the heating elements 34 and the filaments contained therein.

As depicted in FIG. 3, the elongated heating elements 34 are arranged in a parallel array in which the elements are spaced apart to preclude overheating and allow the flow of cooling air therearound. Preferably, the heating elements 34 are high intensity electrical lamps capable of generating a power density on the order of 110 watts/cm$^2$, such as, for example, quartz lamps with tungsten filaments made by General Electric Co. (Model Q6M/T3/CL/HT). Since the high heat energy produced by the heating elements 34 causes differential elongation/expansion of the elements, the heating elements are preferably supported with their end portions 35 disposed in the mounting brackets 36 to prevent cracking and fracture thereof. Electrical contact means for the heating elements 34 is provided in the form of wires 38 attached to an elongated electrical contact plate 39 and extending through the hollow mounting brackets 36 to metallic clamps 37 secured around the end portions 35 of the heating elements 34. Further support for the end portions 35 of the heating elements 34 may be provided in the form of elongated U-shaped support elements 40 which cradle the end portions 35 of the heating elements and which are supported within the mounting brackets 36.

Spacer means for maintaining the heating unit 11 in a spaced apart but closely adjacent relationship to the coating surface 13 comprises a plurality of rollers 46 which are mounted on flanges 45 that extend from the side of the heating unit 11. Various height adjusting and spring elements may be incorporated into the roller assemblies to adjust the spacing between the heating elements 34 and the coated surface 13.

The exhaust gasses contained in the exhaust chamber 28 are drawn through the exhaust conduit 43 to either an exhaust gas afterburner 51, such as manufactured by Regenerative Environmental Equipment Co. (Model C), Morris Plains, N.J., or an activated charcoal gas adsorption column 52, such as manufactured by Calgon Corporation, Pittsburgh, Pa. The afterburner unit 51 and the gas adsorption column 52 can be positioned at a remote location, such as outside the drydock, by utilizing a long, flexible exhaust conduit 43 and a blower unit 44 of sufficient capacity to draw not only the gasses and vapors from the heating chamber 22 but also air drawn into the exhaust chamber 28 through the spacing defined between the housing 15 and the coating surface 13. This prevents the escape of toxic gasses and vapors from the gap defined between the housing and the coating surface.

In operation, the heating unit 11 is initially supported from the side of the ship on a tether line 47 as shown in FIG. 1. The operator then proceeds to grasp the handles 48 and move the heating unit 11 along the coated surface of the ship. A "dead man" switch 49 is incorporated into the handles 48 so that the heating elements 34 are activated only when the operator is grasping the handles 48. Irrespective of whether the heating unit 11 is moved in a vertical manner (i.e. from the bottom to the top of the hull surface) or in a horizontal manner, the heating unit 11 should be oriented so that the exhaust conduit 43 is disposed along the trailing edge portion of the heating unit 11 as it is moved across the hull surface. As shown in FIG. 3, the region of the exhaust chamber 28 adjacent the exhaust conduit 43 is provided with a baffle element 29 having a plurality of holes. This arrangement causes the gasses/vapors emanating from the antifouling coating 13 to move opposite to the direction of travel of the heating unit 11, thereby precluding "clouding" of the unprocessed coating by the exhaust vapors and permitting efficient application of heat energy to the antifouling coating. The baffle element 29 also causes the gasses/vapors to flow into the side channels 30 of the exhaust chamber 28 to preclude a build-up of gasses/vapors adjacent the trailing edge portion of the heating chamber 22 that is defined adjacent the exhaust conduit 43. As the heating unit 11 is moved across the hull surface, the individual infrared heating elements 34 should be positioned in a horizontal alignment to prevent sagging and breakage of the tungsten filaments as they undergo thermal expansion.

While having general applicability to a variety of types of coatings, the heating unit 11 is especially suited for removing/detoxifying antifouling materials in marine antifouling coatings. For example organometallic substances such as tributyltin oxide and tributyltin fluoride are widely used antifoulant materials that decompose under certain conditions to produce relatively safe byproducts. It was found that by subjecting antifouling coatings containing organometallic antifoulants such as tributyltin oxide or tributyltin fluoride to heat energy of about 115 watts/cm$^2$ for about 7.5 seconds (i.e. alternatively about 125 watts/cm$^2$ for about 4.0 seconds) the organometallic materials decompose as shown below:

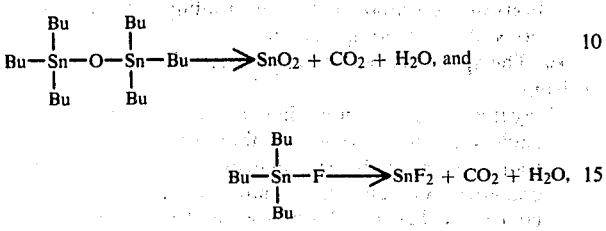

where Bu represents butyl groups (—$C_4H_9$), Sn represents tin, O represents oxygen, and F represents fluorine.

The requisite amount of heat energy necessary to remove these organometallic antifoulants from the coating will vary according to the particular type of coating base (eg. neoprene, polybutadiene, polyisobutylene, polyacrylates, epoxy resins, etc.). However, in general, the applied power density for a coating having a thickness of between about 6 to 15 mils should preferably range from between about 140 watts/square centimeter for about 4.0 seconds to about 110 watts/square centimeter for about 7.5 seconds. This amount of energy has been found sufficient to raise the temperature of the coating 13 above 800° F.

Since the oxidation process of the antifouling materials within the heating chamber is not normally complete, further treatment of the exhaust gasses and coating residue is accomplished in one of the preferred types of exhaust gas treatment means shown in FIG. 1.

In the afterburner unit 51, the unoxidized exhaust products from the heating chamber 22 are further burned (oxidized) to complete the oxidation process. Further, in gas adsorption column 52 the exhaust products from the heating chamber 22 are adsorbed into the filter materials in the column so that the efflux therefrom is non-toxic to the environment.

Obviously many modifications and variations of the present invention are possible in light of the above teachings. For example, both an oxyacetylene flame and a $CO_2$ laser have been shown to effectively remove/detoxify antifouling coatings. With an oxyacetylene torch, a size #3 cutting tip was used with oxygen at 40 psi. and acetylene at 7 psi., with the torch positioned about 15 cm. above the coating surface, and with the torch moved across the surface at a rate of about 12.5 cm./second. A $CO_2$ laser was used to apply a power density of about 125 watts/cm.$^2$ for a residence time 4.0 seconds. However, both of these coating removing means were found to produce large amount of exhaust products which are released to the environment. It is therefore to be understood that within the scope of the appended claims the invention may be practiced otherwise than as specifically described.

What is claimed is:

1. A method of removing and detoxifying organotin antifoulants from marine antifouling coatings having a thickness of between about six and fifteen mils comprising the steps of:

moving an infrared heating unit across an antifouling coating region of the hull surface so that a power density is applied to the coating region of between about 110 watts/square centimeter and about 140 watts/square centimeter for between about 7.5 seconds to about 4.0 seconds respectively, thereby raising the temperature of the coating above 800° F.;

collecting the gasses and vapors given off from the heated coating region; and treating the collected gasses and vapors to remove toxic substances therefrom prior to passing the collected gasses and vapors to the environment.

2. The method of claim 1 wherein the organometallic antifoulants are selected from the group of tributyltin oxide and tributyltin fluoride antifoulants.

3. The method of claim 1 wherein the organometallic antifoulants are selected from the group of tributyltin fluoride, tributyltin oxide, tripropyltin fluoride, and tripropyltin oxide.

4. An electrical paint stripping apparatus for removing organometallic antifouling coatings from a ship surface comprising:

a housing designed to be supported adjacent to the coated surface;

a heating chamber formed in the housing and having an opening therefrom so that heat generated in the heating chamber is directed toward the coated surface;

a plurality of elongated electrical heating elements positioned in the heating chamber in spaced apart relationship for generating a power density within the chamber above 110 watts per square centimeter;

a plenum chamber formed in the housing for supplying cooling air to the electrical heating elements;

a ceramic separator element positioned between the plenum chamber and the heating chamber for reducing the transfer of thermal energy therebetween and for reflecting thermal energy into the heating chamber, the ceramic separator element is provided with a plurality of passages extending therethrough for permitting the flow of cooling air from the plenum chamber to the heating elements in the heating chamber;

a plurality of elongated tubular mounting brackets projecting through the separator element for supporting the end portions of the elongated heating elements and for supplying cooling air to the heating elements in the heating chamber;

an air inlet connected to the housing and communicating with the plenum chamber;

blower means connected to the air inlet for supplying air to the plenum chamber;

a circumferential exhaust chamber surrounding the heating chamber and communicating therewith for receiving exhaust gasses from the heating chamber;

an exhaust conduit connected to the exhaust chamber;

an exhaust blower means connected to the exhaust conduit for drawing exhaust gasses from the exhaust chamber; and an exhaust gas treatment means connected to the exhaust conduit for treating the exhaust gasses to remove toxic substances therefrom prior to passing the gasses to the environment.

5. The apparatus according to claim 4, wherein the relative sizes and numbers of the separator passages and the passages in the mounting brackets are arranged so that the amount of air passing through the mounting brackets comprises from about 50 to about 65 percent of the amount of cooling air passing through the separator passages and the mounting brackets.

6. The apparatus according to claim 4, further comprising:

a baffle element positioned in the exhaust chamber adjacent to the exhaust conduit for reducing the flow of gasses from the portion of the heating chamber adjacent the exhaust conduit so the flow of exhaust gasses from different portions of the heating chamber to the exhaust chamber is substantially uniform.

7. The apparatus according to claim 4, further comprising:

spacer means connected to the housing for supporting the housing in spaced, adjacent relationship with a hull surface so that air is drawn into the exhaust chamber through the space between the housing and the hull surface for mixing with the gasses from the heating chamber and for precluding the escape of the gasses passing from the heating chamber to the exhaust chamber.

8. The apparatus according to claim 4, further comprising:

handles secured to the housing and a switch means secured thereto and connected to the electrical heating elements so that the electrical heating elements are activated only while an operator is grasping the handles.

9. The apparatus according to claim 4, further comprising:

elongated U-shaped support elements positioned within the tubular mounting brackets with the legs of the support elements engaging the interior surface of the mounting brackets and U-shaped portions of the support elements cradling the end portions of the heating elements.

10. The apparatus according to claim 4, further comprising:

elongated ceramic side elements circumferentially enclosing the heating chamber for reducing the transmission of thermal energy from the heating chamber, wherein the ceramic side element adjacent the exhaust conduit is at least as deep as the other ceramic side elements.

11. The apparatus according to claim 4, wherein the exhaust gas treatment means comprises a combustion device for oxidizing the incompletely oxidized substances in the exhaust gasses from the exhaust chamber.

12. The apparatus according to claim 4, wherein the exhaust gas treatment means comprises a gas adsorption column containing activated charcoal particles for removing toxic substances from the exhaust gasses from the exhaust chamber.

* * * * *